United States Patent [19]

Laughon et al.

[11] Patent Number: 4,546,357

[45] Date of Patent: Oct. 8, 1985

[54] FURNITURE ANTENNA SYSTEM

[75] Inventors: Thomas C. Laughon, Alpharetta, Ga.; H. Taylor Haynes, Charlotte, N.C.; Robert T. Klopach, State College, Pa.; Richard C. Warner, Morris Plains, N.J.

[73] Assignee: The Singer Company, Stamford, Conn.

[21] Appl. No.: 484,076

[22] Filed: Apr. 11, 1983

[51] Int. Cl.[4] ..... H01Q 1/24

[52] U.S. Cl. ..... 343/702; 343/873

[58] Field of Search ..... 343/795, 803, 873, 702

[56] References Cited

U.S. PATENT DOCUMENTS

| | | | |
|---|---|---|---|
| 2,401,472 | 6/1946 | Franklin | 343/895 |
| 2,551,664 | 5/1951 | Galper | 343/803 |
| 2,614,220 | 10/1952 | Doerner | 343/720 |
| 2,714,625 | 8/1955 | Gould | 343/702 |
| 2,719,919 | 10/1955 | Enslein | 343/702 |
| 2,888,676 | 5/1959 | Spindler | 343/803 |
| 3,020,550 | 2/1962 | Beever | 343/795 |
| 3,261,019 | 7/1966 | Lundy | 343/720 |
| 3,299,430 | 1/1967 | Huber et al. | 343/812 |
| 3,587,105 | 6/1971 | Neilson | 343/720 |
| 3,604,007 | 9/1971 | Solby | 343/720 |
| 3,611,388 | 10/1971 | Okumura | 343/712 |
| 3,689,929 | 9/1972 | Moody | 343/802 |
| 3,779,879 | 12/1973 | Swift et al. | 343/873 |
| 3,780,373 | 12/1973 | Holst et al. | 343/873 |
| 3,977,003 | 8/1976 | Kershaw | 343/702 |

*Primary Examiner*—Eli Lieberman

*Attorney, Agent, or Firm*—Edward P. Schmidt; Robert E. Smith; Edward L. Bell

[57] ABSTRACT

An antenna system for an article of furniture in which a panel of the article of furniture is sealed by a low loss dielectric material to isolate the panel from impurities which affect its electrical integrity. An antenna structure is applied thereon by silk screening, painting or otherwise marking of a conductive ink, or by vacuum deposition techniques, or by application of stamped or die cut foil, or by metallic tape, all by way of example. Connections to the antenna structure are made by compressing a conductive elastomeric material against terminations of the antenna structure so as to avoid temperature or other initiated dimensional changes of the panel which could effect the contact resistance to the terminations of the antenna structure, and also to avoid damaging the antenna structure. A specific connection arrangement is disclosed.

4 Claims, 8 Drawing Figures

FURNITURE ANTENNA SYSTEM

DESCRIPTION

Background of the Invention

This invention relates to an antenna system for articles of furniture; more particularly, it relates to an improved means for attaching an antenna to an article of furniture and for making connections thereto.

A considerable amount of effort has been expended in the prior art in the development of various antennas systems which would be both decorative and effective for their intended use. Many of these prior art devices were only usable in specific locations because of a need for support and/or for orientation. For example, U.S. Pat. No. 2,821,710 discloses a television antenna system which is supported in a picture frame that, for other than local reception, must be supported on a wall facing the broadcasting station. Such an arrangement also required a connection extending from the picture frame to the television receiver, wherever situated. In order to avoid extending the antenna leads over open areas and to avoid long antenna leads, the television set is most frequently located adjacent the picture.

Many modern television sets are provided with their own set of "rabbit ears" which may be utilized when an external antenna is not used. However, it frequently occurs, that a change of channel requires a repositioning of the antenna in order to optimize reception.

U.S. Pat. No. 2,714,625 discloses an early television cabinet utilizing steel beams as a frame work which also become part of an antenna system for the television. U.S. Pat. No. 2,719,919 discloses a built-in antenna system which is carried internally of a television cabinet and may be rotated to improve reception. The U.S. Pat. No. 3,689,929 discloses an antenna structure which may be applied to a polyvinylchloride substrate by thin film deposition. Such a structure is planned for insertion under a carpet or in an attic, to be connected to a receiver by a conventional transmission line.

What is not disclosed by the prior art, is an antenna system using a compact non-directional antenna formed as an integral part of an article of furniture so as to assure reasonably good reception in any location in a room without the need to run antenna leads to a remote location. What is further required is such an effective antenna system of very low cost construction which lends itself to mass production techniques.

SUMMARY OF THE INVENTION

The above requirements are found in an antenna system in which the construction material for the article of furniture is sealed, where required to preserve electrical integrity of the antenna structure, in the area of the antenna application by a low loss, dielectric material. This may be accommodated by adhering thereto a film of polytetrafluorethylene or polyethylene material or by coating with a polyurethane material. The construction material for the article of furniture may be previously treated with any initial coat commensurate with its purpose such as a protective varnish coat for a back panel of a cabinet. An antenna configuration having desired non-directional characteristics may be applied on this high dielectric material by silk screening, painting or otherwise marking the configuration thereon using conductive inks. Other application methods may also be appropriate. A transmission line connection is made to the antenna through the use of and elastomeric conductive washer which is deformed against the cured ink sufficiently to assure good contact and provide against swelling or contraction of the construction material. The elastomer used is preferably a silver filled composition and the hardware is zinc plated when used with a silver rich conductive ink in order to avoid galvanic corrosion which would increase the contact resistance between the various connective elements. This antenna configuration, once cured, may be protected by the application of a hard finish and high dielectric constant material thereover. This final hard finish coat is designed to protect the silk screened antenna against abrasion and oxidation.

DESCRIPTION OF THE DRAWINGS

For the purpose of illustrating the invention, there are shown in the drawings the presently preferred form of the invention in which:

Referring now to FIG. 1 there is shown by way of example a cabinet 10 which is an article of furniture in which an FM tuner or radio 11 might be supported. By way of further example, cabinet 10 might be a cabinet head board of a bed, or, indeed, any other article of furniture in which an FM radio might be located or supported. Visible on a back panel 12 of cabinet 10 is an antenna system 14 which will be explained below. As will further be explained below, it is not necessary that the antenna system 14 be as visible and as apparent as herein disclosed for the purpose of explanation thereof. It will also be apparent when the explanation of this antenna system 14 is complete, that the antenna system might be located on any panel of the cabinet and/or similar article of furniture. Thus, the antenna system 14 might be located upon the inside or the outside of the panel 12 or on the side panels or doors of the article of furniture.

Referring now to FIG. 2, an enlargement of the portion of the back panel 12 upon which the antenna system 14 has been located is disclosed. The antenna 44 of the antenna system 14 is seen to have an overall rectangular shape fashioned by a trace 16 discontinuous in areas 18 and 19. The antenna system 14 is essentially two dimensional, having very little thickness; and may be applied to a surface as small as 19 inches by 12 inches. At the discontinuity 19, which are the terminations of the trace 16, connections are made in a fashion to be explained below to an 300 ohm impedance twin lead 20 which is attached to the panel 12 adjacent the connections by a device to protect the connections from strain, in this event, by an insulating staple 22. The twin lead 20 may be of sufficient length to permit the other end thereof to be connected to an FM radio 11 by a means of spade lugs 24.

Referring now to FIG. 3, there is shown a cross-section of the back panel 12 taken along the line 3—3 of FIG. 2 in order to show the details of construction of the antenna system 14. The back panel 12 may be fashioned from wood, or other wood materials such a fiberboard, chipboard, or may be fabricated from plastic, glass, cardboard or, indeed, any material from which a back panel or side panel of an article of furniture may be fabricated. The back panel 12 shall be referred to throughout this description, although it is to be understood that this could be taken to mean a door or front, side or back panel upon which it has been advantageous to locate the antenna system 14. The back panel 12 might be treated to apply a finish 25 thereto as an article of furniture. Atop this finish, and to both surfaces and all edges, is applied a coating of a low loss dielectric sealing material 26 such as film of polytetrafluorethylene or polyethylene or a coat of polyurethane. The purpose of this sealing material 26 is to provide a base with constant electrical properties for the anttena system 14 on the back panel 12 and avoid an increase in, for example, moisture content which would degrade antenna performance. The sealing material should be effective to shut out materials such as petroleum base furniture polishes which would also cause a loss to the antenna system 14. The presently preferred low loss dielectric material 26 is a vinyl based coating, or a nitrocellulose based sealer for wood or wood products. It is apparent that for a material sometimes used in furniture construction and having a stable low loss dielectric constant, impervious to chemicals, and non-absorbant of water, such as glass, a sealing material 26 is not required; but that a material to enhance adherence of the traces 16 of an antenna structure may be required. The traces 16 may be applied to the low loss dielectric sealing material 26 by silk screening or by painting or marking thereon using a conductive ink having the proper electrical properties, more of which below. The presently preferred technique for applying the traces 16 on the low loss dielectric sealing material 26 is by silk screening, although it will be appreciated that the selection of a particular method is an economic decision which may change depending upon the development of conductive inks and of methods for applying the same. Alternatively, the trace 16 may be implemented in any way determined to be economically advantageous. Other possible methods include the use of stamped or diecut foil, metallic tape, vacuum deposition, etc. The presently preferred conductive material is Metech 6100, a silver rich, silk screenable, conductive ink which exhibits high conductivity even when the silver is oxidized. A copper rich ink might also be used, but may become ineffective as an antenna if the copper oxidizes and assumes insulating properties. If required, the traces 16 might be put through a suitable curing operation before a hard finish, low loss dielectric overcoat material 28 is applied over the traces 16 and dielectric sealing material 26 primarily in order to protect the traces against abrasion and oxidation and other corrosive elements. A presently preferred hard finish overcoat material 28 is either a polyurethane based resin, or a nitrocellulose based lacquer, or a polyurethane based lacquer, which materials may be obtained from Reliance Universal of High Point, N.C. A certain portion of the trace 16 is protected from the overcoat material 28 for a purpose to be explained below. Although not shown, it will be appreciated that the hard finish overcoat material might be covered with a non-conductive paint, varnish, wood veneer, plastic or other material, together with the rest of the back panel, for concealment of the antenna system 14 without affecting the operation thereof.

Referring to FIG. 4, which is a section taken along lines 4—4 of FIG. 2 to show the manner of connection to the traces 16, there is visible a portion of trace 16 which was masked by connection elements which served to prevent overcoating by the overcoat material 28. In the form of the connection elements disclosed in FIG. 4, a tubular rivet 30 extends through an aperture 40 in the back panel 12, sealing material 26 and trace 16, with a head 31 thereof seated in a countersink in the back panel. The external surface of the tubular rivet 30 may be striated to lock the same against rotation within the aperture 40 of the back panel 12. The internal surface 32 of the tubular rivet 30 may be threaded to receive a screw 38. The tubular rivet 30 extends through a conductive elastomeric washer 34 which may be implemented by a carbon filled conductive elastomeric material supplied by Technit, Inc. of Cranford, N.J. The tubular rivet 30 then extends through a washer 36, and the end thereof is staked over to deform the elastomeric washer 34 against the trace 16. The elastomeric washer 34 may be deformed sufficiently to insure a safe non-abrading pressure contact between the elastomeric washer and the trace 16 regardless of any change which might bring about a change in dimension, as well as to insure adequate contact pressure therebetween at temperature extremes. Screw 38 retains spade lugs 24 to a selected end of tubular rivet 30, as indicated by including the screw in one end in phantom. Alternatively to the structure disclosed, a screw, washer and nut may be used to obtain a controlled compression of the elastomeric washer 34, and a second nut might be used to capture spade lugs 24 of the 300 ohm impedance twin lead 20 connected to the antenna system 14. The hardware may be anodized to approximate the coloration of the article of furniture for decorative purposes. Consideration should be given to the electromotive force series in the selection of hardware, conductive ink and conductive elastomer so as to avoid the deleterious effects of chemical interaction (galvanic corrosion) on contact resistance. No chemical interaction will occur between the elements of the antenna feed connections when silver or carbon filled elastomer and zinc plated nuts, bolts and washers are used. If desired, the overcoat material 28 may cover the elastomer and the hardware to seal these elements from external damage.

Figure 1:
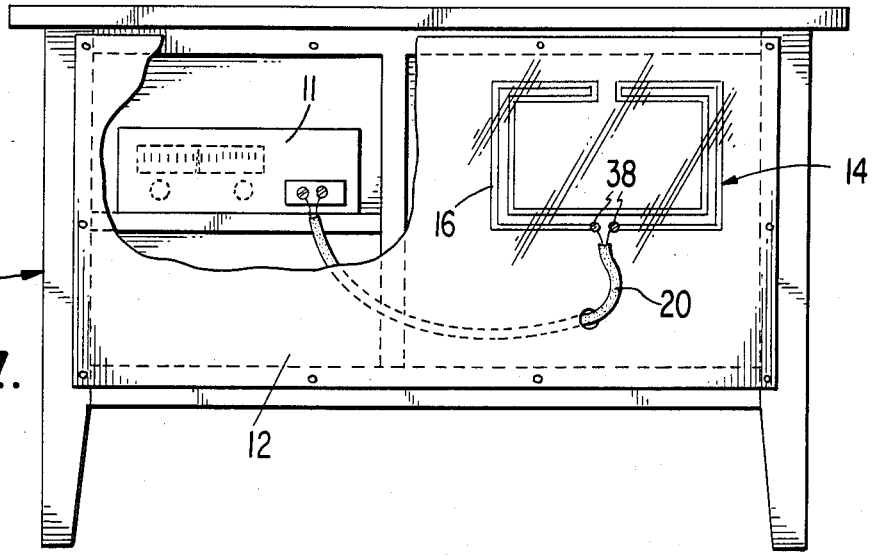
FIG. 1 is a rear elevational view, partially broken away, of a cabinet in which the invention has been incorporated on a back panel thereof.

The antenna system 14 thus provided can be applied on the inside surface of an article of furniture in order to provide concealment, or may be provided on an external surface of the article with concealment being provided by an overcoat of an opaque finish or veneer or plastic covering. The panel 12 might also be grooved or relieved to accept the antenna system 14 herein disclosed, and back filled with veneer or other material.

Referring once again to FIG. 2, the dimensioning for the antenna 44 of the antenna system 14 is disclosed. The antenna 44 was designed as a two dimensional FM antenna which should fit within a 20" by 13" rectangle. Other design goals were (1) a voltage standing wave ratio (VSWR) L into 300 ohms impedance and (2) non-directionality such that signal loss is no more than ten dB of maximum over 360°. The antenna 44, a folded dipole configuration, was chosen because of its 280 ohms theoretical input impedance at a half wavelength.

Virtually all modern FM receivers have a 300 ohm input, and thus the antenna 44 might be connected directly to this input by a 300 ohm twin lead cable 20, without the need for an impedance matching transformer. It was empirically determined that a $\frac{1}{4}''$ trace width 46 provided the same results as $\frac{1}{2}''$ trace width. The lower elongated base trace 48 is 19" long with a centrally located half inch separation 10 to which the terminal connections are made. The lateral traces 50 extend $11\frac{3}{4}''$ upwardly from the outer ends of the base trace. Each opposite trace 52 extends $8\frac{3}{4}''$ from the laterial traces with a centrally located 1" gap 18 therebetween. 1" long spacer traces 54 connect the opposite traces 52 to $7\frac{3}{4}''$ long return opposite traces 56 so as to provide for a 1" separation therebetween. Return lateral traces 58 are separated by 1" from the lateral traces 50 and extend $9\frac{1}{4}''$ from the return opposite traces 56 to a $15\frac{1}{2}''$ long return base trace 60, which is also spaced 1" from the elongate base trace 48. Thus, the outer envelope of the traces is a 12"×19" rectangle.

The traces for the antenna 44 may be implement in many ways. In addition to silk screening, marking or painting of the traces with a conductive ink, it may also be formed of stamped or die cut foil, metallic tape, vacuum deposited or applied by sputtering techniques. The method for formulating the traces for the antenna 44 is determined by economics and involves the cost of the material and the ease of application. The presently preferred method is the silk screening of a silver rich conductive ink. Some of the factors considered in the selection of a method of application and of a material are (1) that low surface resistance is attainable by increasing silver concentration of ink at an increased cost, (2) that material for silk screened application are more expensive but cause less waste during production, and (3) that other conductive pigments are lower cost but exhibit disadvantages such as early oxidation, high surface resistance or not silk screenable. Satisfactory results were achieved with a silk screenable ink having 48% silver content.

Skin depth is used to determine the thickness of material needed to efficiently propogate electromagnetic energy. One skin depth is thickness at which $1/\epsilon$ or 1 / 2.78 energy drop occurs. Skin depth is smaller for higher conductivity, higher permeability and higher frequency, as indicated by the following relationship:

$$\delta = \frac{1}{\sqrt{\pi f \mu \sigma}}$$

where $\delta$=skin depth;

f=frequency;

$\mu$=permeability;

$\sigma$=conductivity.

In antenna design, a rule of thumb is that the antenna should be 10 skin depths thick to avoid loss of the RF energy, which normally passes along the surface only, into the substrate on which the antenna is mounted. However, the loss in signal beyond 5 skin depths is not perceivable by an ordinary listener of a commercial FM stereo receiver. Accordingly, three to six skin depths of thickness will be sufficient. Skin depth for silver is 0.00026 inch at 100 megahertz. Thus, a 0.001 inch (4 skin depths) dry thickness of silver ink is adequate. Such a thickness might be readily obtained by any of the processes herein disclosed, in an initial trial and error period before starting manufacturing operations.

Figure 2:
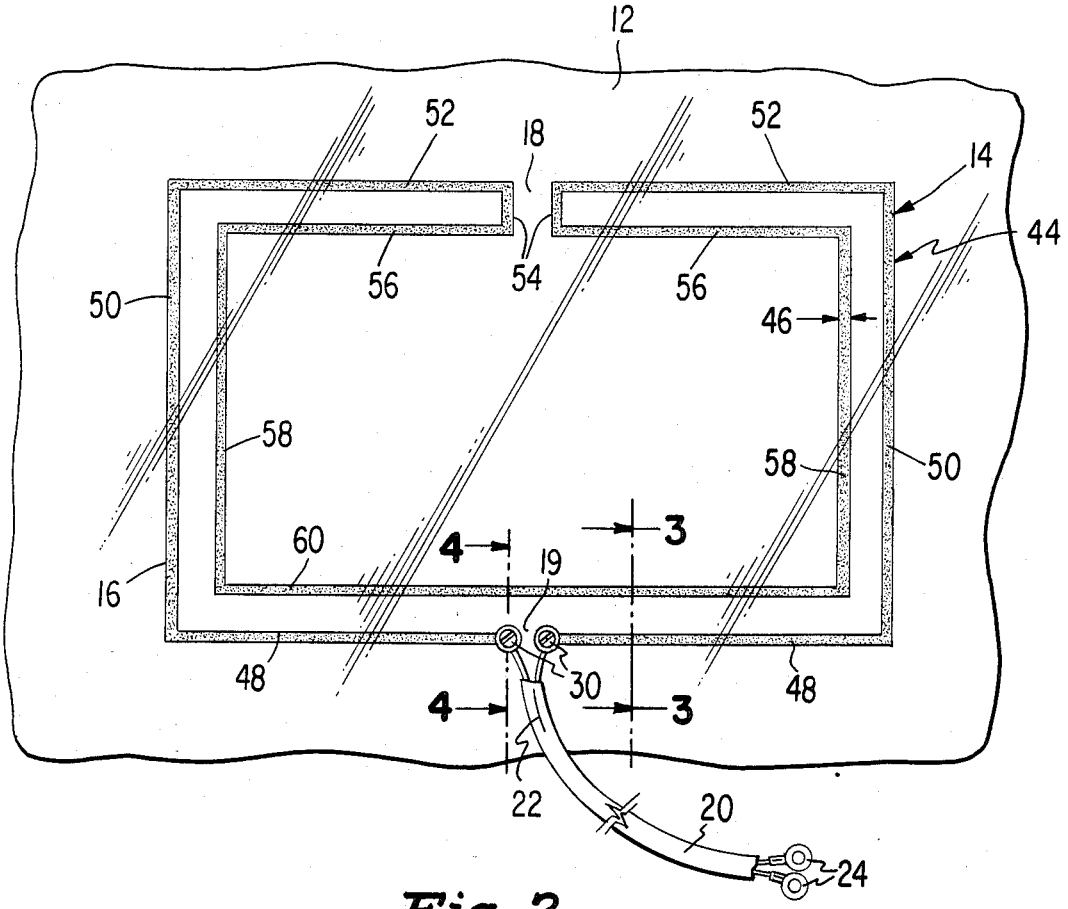
FIG. 2 is an enlarged view of the antenna carrying portion of the panel shown in the cabinet in FIG. 1 to shown the geometry thereof.
Figure 3:
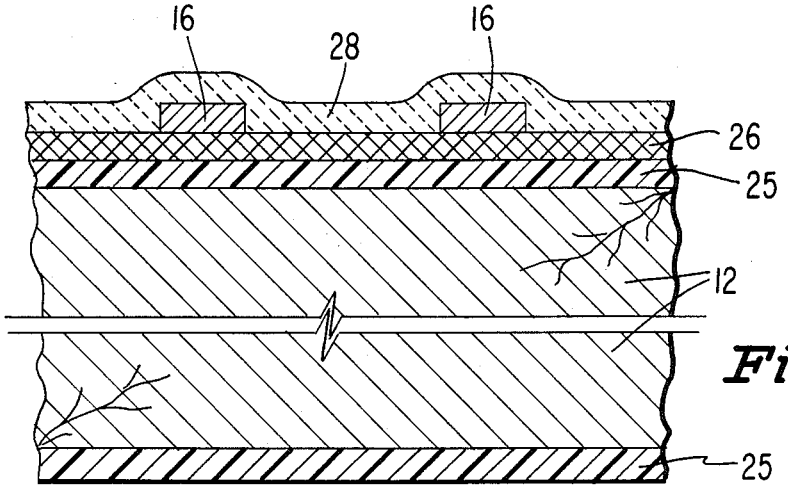
FIG. 3 is section taken along line 3—3 of FIG. 2.
Figure 4:
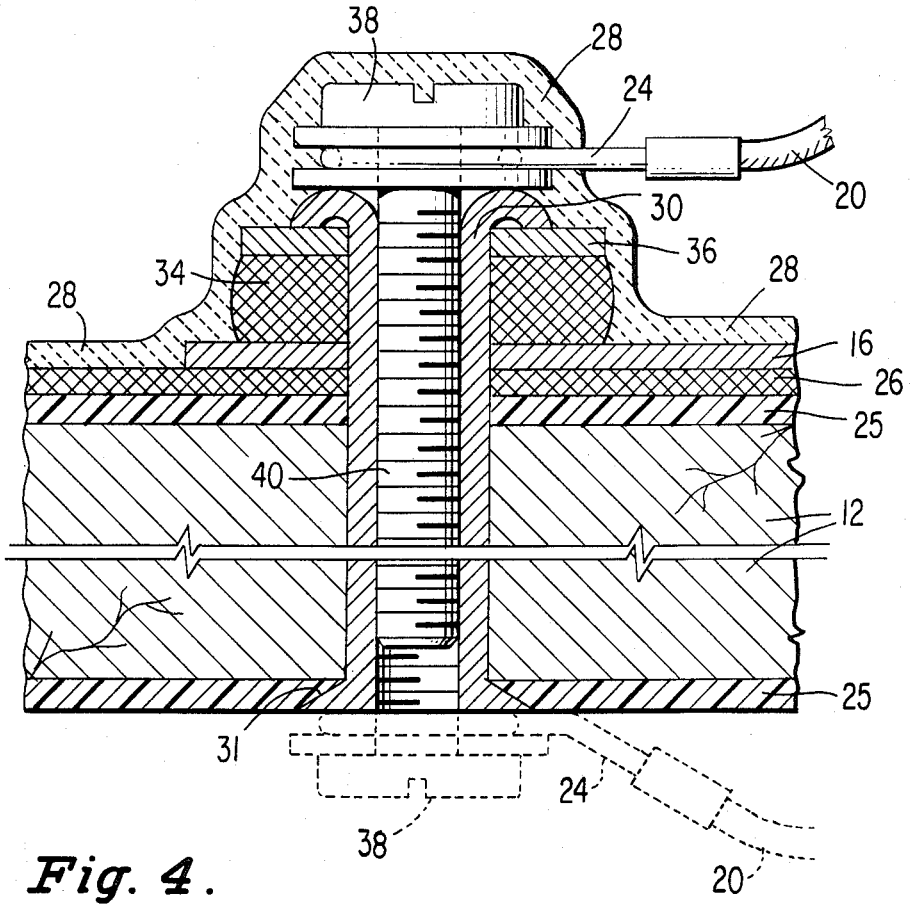
FIG. 4 is a section taken line 4—4 of FIG. 2.
Figure 5A:
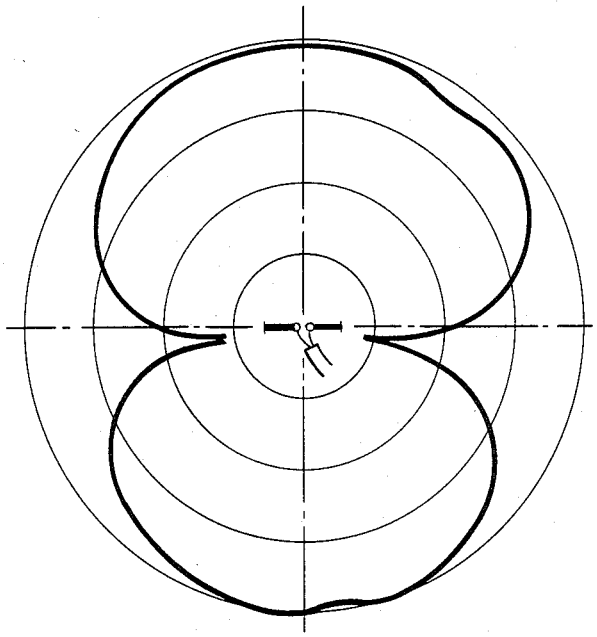
FIGS. 5*a* and 5*b* are field strength charts of the antenna shown in FIG. 2 horizontally and vertically polarized, respectively; and, FIGS. 6*a* and 6*b* are field strength charts of commercial FM one half wave dipole horizontally and vertically polarized, respectively, for comparison purposes with FIGS. 5*a* and *b*.
Figure 5B:
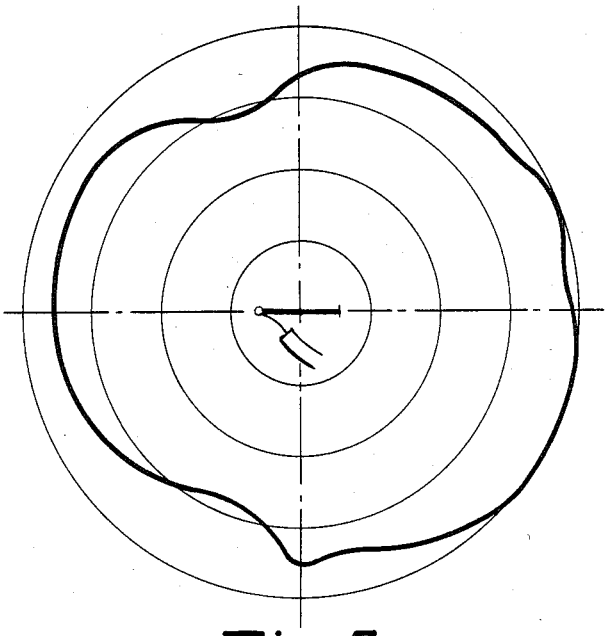
Figure 6A:
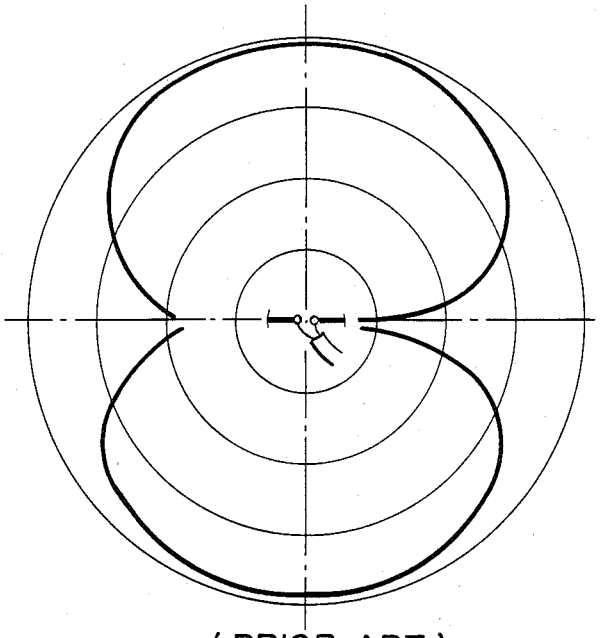
(PRIOR ART) Fig. 6A.
Figure 6B:
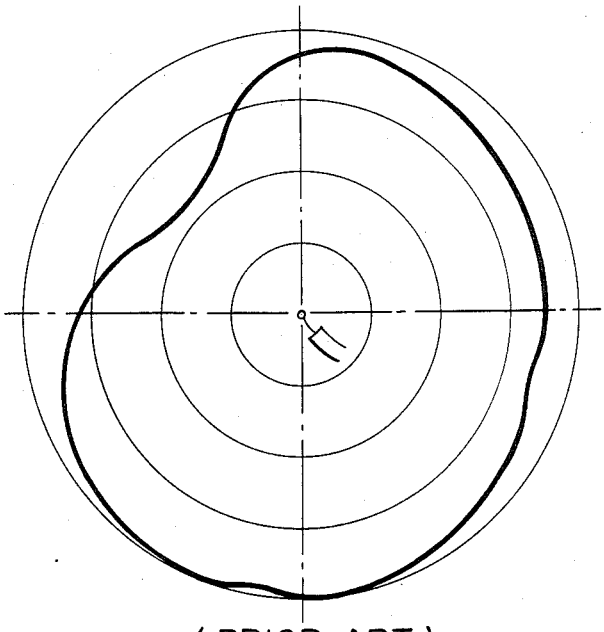
(PRIOR ART) Fig. 6B.

FIGS. 5*a* and *b* are normalized polar plots of field strength of the antenna shown in FIG. 2 responsive to horizontally polarized and vertically polarized transmitting antennas, respectively. These figures can be directly compared to FIGS. 6*a* and *b* which are corresponding plots of a commercial FM one half wavelength dipole. These normalized plots are indications of signal strength in dB below maximum. Absolute signal strength is not shown, however, the maxima are comparable in both antennas, even though the commercial dipole is more than three times as long as the largest dimension of the antennas disclosed in FIG. 2. Although a theoretical horizontal dipole will not receive a vertically polarized signal, a slight tilt in orientation from horizontal produces a vertical projection which intercepts vertical signals. Thus, the antenna structure shown in FIG. 2, which is essentially two dimensional, will receive random polarized signals.

While a particular modification has been shown and described and given certain definite dimensions, it is to be particularly understood that our invention is not to be limited thereto but that modifications may be made within the scope of the invention.

We claim:

1. An antenna system including an antenna structure for an article of furniture having an exterior coated finish, said antenna system comprising:

a coating of low loss dielectric sealing material applied over at least a specific portion of the exterior finished surface of said article of furniture upon which said antenna structure of said antenna system may be applied where required to avoid a loss of signal from said antenna structure;

said antenna structure comprising trace coatings of conductive ink applied to said article of furniture over said sealing material;

means for making an electrically conductive connection to said trace coatings; and a coating of sealing and abrasion resistant material applied over said trace coatings and said connection means.

2. A method for manufacturing an antenna system including an antenna structure for an article of furniture, said method comprising steps of:

providing an article of furniture with at least one exteriorly coated finished panel; coating at least a specific portion of the exterior finish of said furniture panel with a low loss dielectric sealing material to avoid a loss of signal from said antenna structure;

applying trace coatings of conductive ink over said coating of said dielectric sealing material to provide an antenna structure;

making electrically conductive connections to said antenna structure by using a conductive elastomeric material to make contact with said trace coatings; and, concealing said trace coatings with a coating of sealing and abrasion resistant material.

3. The method as set forth in claim 2 further including coating an opaque substance over said sealing coatings to conceal said antenna structure.

4. The method as set forth in claim 3 in which said coating of opaque substance and said coating of sealing and abrasive resistant material are applied simultaneously as a single coating.

* * * * *